United States Patent [19]

Le Sonn

[11] 4,437,188

[45] Mar. 13, 1984

[54] X-RAY EMITTING ASSEMBLY COMPRISING A FLANGE FOR ASSEMBLING A SHEATH ASSEMBLY AND A BEAM LIMITING DEVICE

[75] Inventor: Marcel Le Sonn, Paris, France

[73] Assignee: Thomson-CSF, Paris, France

[21] Appl. No.: 374,408

[22] Filed: May 3, 1982

[30] Foreign Application Priority Data

May 8, 1981 [FR] France ..... 81 09229

[51] Int. Cl.[3] ..... G21K 1/00; G21K 1/02; G21K 5/10

[52] U.S. Cl. ..... 378/205; 378/210

[58] Field of Search ..... 378/205, 206, 162

[56] References Cited

U.S. PATENT DOCUMENTS 3,156,824 11/1964 Peyser ..... 378/206

FOREIGN PATENT DOCUMENTS 2067317 of 0000 France .
2206511 of 0000 France .

*Primary Examiner*—Alfred E. Smith
*Assistant Examiner*—T. N. Grigsby
*Attorney, Agent, or Firm*—Roland Plottel

[57] ABSTRACT

An X-ray emitting assembly comprising a flange for assembling a sheath assembly and a beam limiting device; the arrangement of said assembly, operationally associated with a radiation detector situated in a radiology equipment stand, enables in a simple way the operating axes of the sheath assembly and of the beam limiting device to be aligned along an axis $z_1$—$z_1$.

14 Claims, 3 Drawing Figures

X-RAY EMITTING ASSEMBLY COMPRISING A FLANGE FOR ASSEMBLING A SHEATH ASSEMBLY AND A BEAM LIMITING DEVICE

BACKGROUND OF THE INVENTION

The invention relates to an X-ray emitting assembly for radiological equipment.

The installation of radiology equipment comprising an X-ray emitting assembly poses a number of problems, among which in particular is the alignment of the operating axes of each of the associated elements.

The X-ray emitting assembly, generally situated above an examination table, cooperates with at least one X-ray detector situated under the examination table; this being for example a luminance amplifier or a seriograph or a radiographic cassette.

In all cases, this X-ray detector is the only element whose position, in the equipment stand, may be considered as centered from the outset; the X-ray emitting assembly must then be positioned so that the X-ray beam which it emits produces a radiation field perfectly centered on the upper plane of the selected X-ray detector. An important difficulty resides in the fact that the X-ray source is rarely perfectly aligned with the axis of the window of the sheath in which it is mounted; for this reason, the device for limiting the beam, which is generally a diaphragm, fixed directly to the sheath by mechanical guide marks, does not ensure the geometrical qualities required for the beam. This defect must be compensated for by varying the relative positions of the sheath assembly and of the diaphragm, so that the axis of the beam coincides with the reference direction of the X-ray beam.

Taking into account also the considerable masses to be handled, these conditions make the alignment operations long and difficult and not without risk for the technician, considering the relatively long X-ray emission times required for these adjustments.

These problems are again met with to the same extent during replacement for any reason whatsoever of the sheath assembly or of the diaphragm.

The present invention relates to an X-ray emitting assembly, the arrangement of which allows some of the drawbacks of the known equipment to be resolved.

This arrangement allows more especially the above described alignment problems to be resolved with simple and easily handled means.

SUMMARY OF THE INVENTION

The invention provides then an X-ray emitting assembly, comprising a flange for assembling a sheath assembly and a beam limiting device, operationally associated with one or more radiation detectors situated in a radiology stand, said flange being arranged to cooperate with alignment means, so as to determine, in a first stage, the positioning of this flange with respect to the operating axis of one of the radiation detectors and, in a second stage, to allow alignment along this axis of the operating axes of the sheath assembly and of the beam limiting device.

BRIEF DESCRIPTION OF THE DRAWINGS

The invention will be better understood from the following explanations and accompanying figures in which.

For the sake of clarity, the same elements bear the same references in all the figures.

DESCRIPTION OF THE PREFERRED EMBODIMENT

Figure 1:
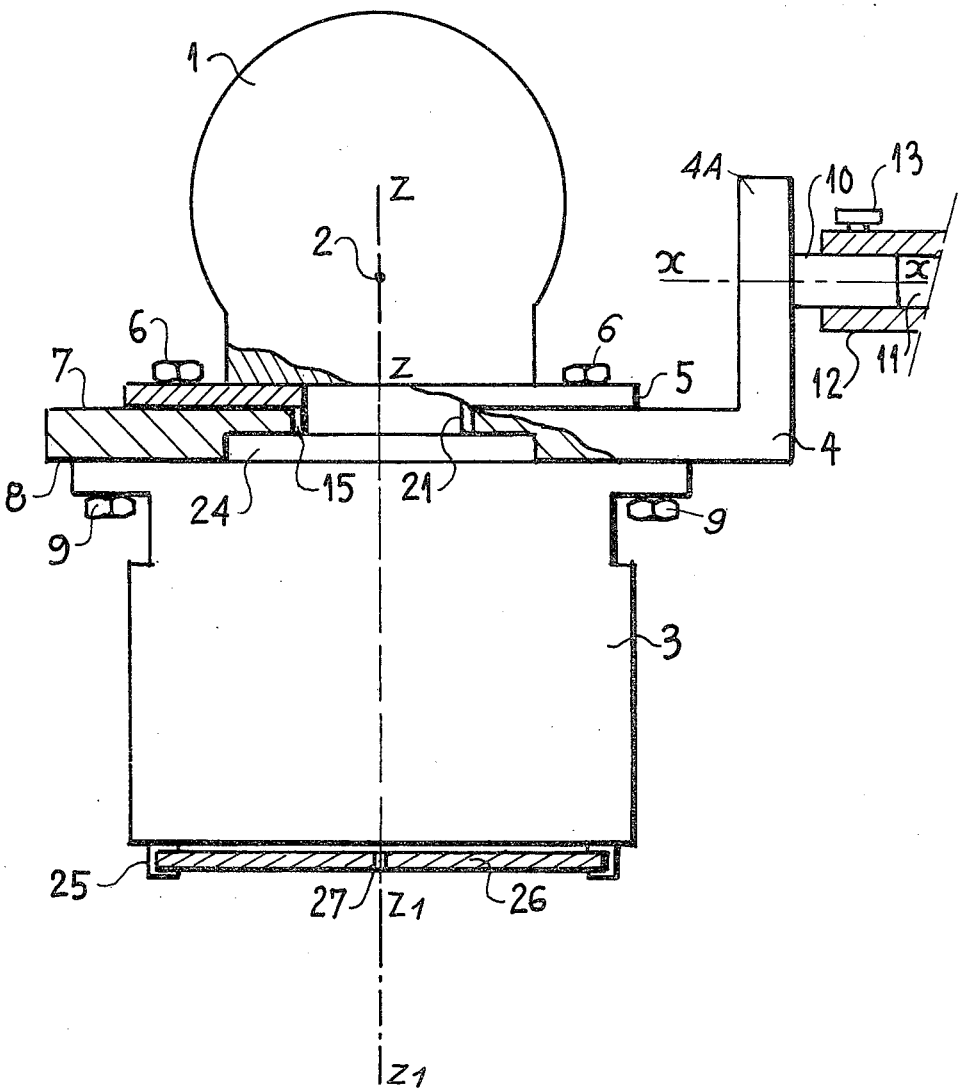
FIG. 1 shows schematically in a partial sectional view an X-ray emitting assembly equipped in accordance with the invention with an assembly flange.
Figure 3:
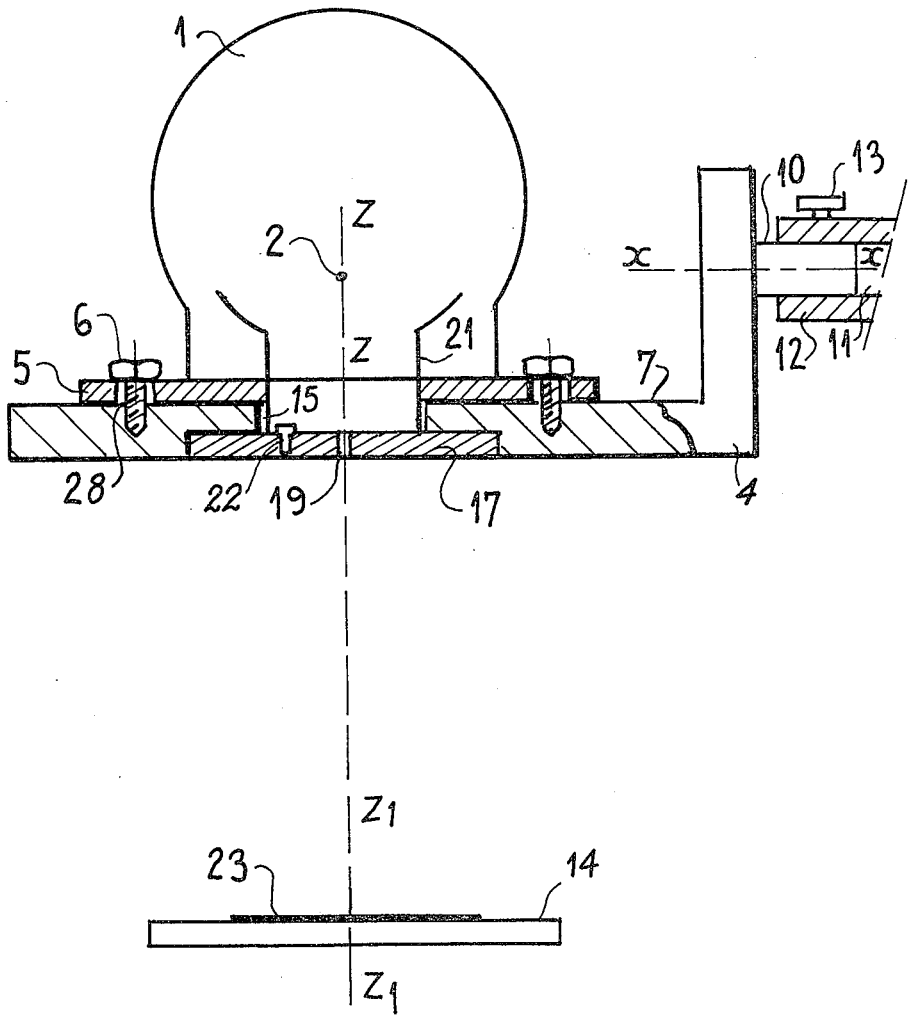
FIG. 3 shows the elements already illustrated in the preceding figures in another phase of cooperation with the alignment means.

As is shown more especially in FIGS. 1 and 3, an X-ray emitting assembly in accordance with the invention is formed essentially by:

a sheath assembly 1, whose X-ray source 2 is shown symbolically by a dot in the drawing;

a beam limiting device which, in the example described, is a diaphragm 3;

an assembly flange 4A which, in the non limiting example of this embodiment, is a bracket 4.

The sheath assembly 1 is integral with a bed-plate 5 by which it is fixed, by means of screws 6, to the upper face 7 of bracket 4; this latter, with its lower face 8, also supports diaphragm 3 fixed by screws 9. The sheath assembly 1 and diaphragm 3 are thus assembled and fixed independently of each other, which forms an important characteristic of the invention since the sheath assembly 1 and diaphragm 3 may be positioned or removed independently of each other.

Bracket 4 comprises a swivel pin 10 engaged in a hole 11, provided along the axis x—x in the end of a tube holder 12; the swivel pin 10 is firmly locked to the tube-holder 12 by the locking screw 13. With this latter loosened, bracket 4 and so the X-ray emitting assembly may rotate about axis x—x and may move parallel to this axis and transversely to the plane of the examination table (not shown).

Figure 2:
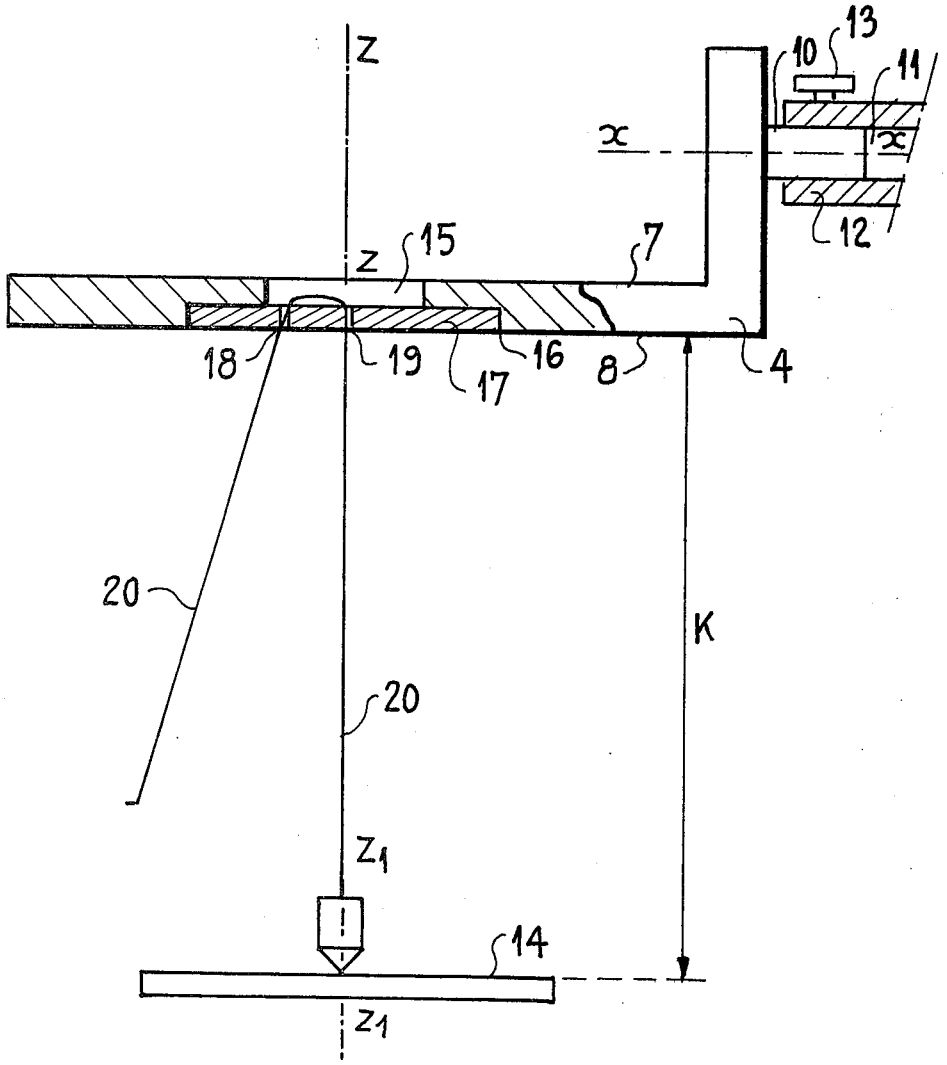
FIG. 2 shows, under the same conditions as in FIG. 1, the assembly flange in one of its phases of cooperation with alignment means.

These two movements allow the position of bracket 4 to be adjusted, before positioning of the sheath assembly 1 and of diaphragm 3; the purpose of these adjustments is to facilitate subsequent alignment, between the X-ray source 2, diaphragm 3 and any radiation detector, not shown in FIG. 1, being possibly, as in the example of this description, a seriograph 14 shown in FIGS. 2 and 3.

FIG. 2 shows the seriograph 14, access to the upper plane of which is freed by the spacing therefrom of the patient carrying panel; this latter not being shown nor the stand in which seriograph 14 is considered as being already centered by construction.

FIG. 2 also comprises the bracket 4, already mentioned, which comprises more especially: a first circular recess 15 formed from its upper face 7, which opens into the center of a second circular recess 16, of larger diameter, formed from its lower face 8; recess 16 is shown in the drawings closed by means of a leaded washer 17 whose diameter allows it to be housed and centered in recess 16.

The leaded washer 17 has passing centrally therethrough a first hole 19, perpendicular to its plane and aligned with the recesses 15 and 16, along an axis z—z.

The horizontality of the upper face 7 (parallel to lower face 8) of bracket 4, checked by any means whatsoever, for example by means of a level, is easily obtained by rotating bracket 4 about axis x—x and adjusting the verticality of a column (not shown) supporting the tube-holder 12, with conventional means which this column comprises.

A plumb line 20, passing through hole 19 of leaded washer 17 and passing out again through a hole 18 also provided through this latter, then merges with the axis z—z which it projects on the seriograph 14, and the movement parallel to axis x—x of bracket 4 allows this latter to be aligned with respect to the operating axis $z_1$—$z_1$ of seriograph 14. This alignment, made visible by the plumb line 20, must not be modified by the variations of distance K, between the lower face 8 of bracket 4 and the upper plane of seriograph 14, if the position of the column supporting the tube-holder 12 is correct; possible adjustment of this latter is facilitated by the presence of the plumb line 20.

The correct positioning of bracket 4 is thus obtained by a means which it comprises, formed by the recess 16, which allows it to cooperate with a first alignment means so as to use the operating axis $z_1$—$z_1$ of seriograph 14 as positional reference. This first alignment means is formed by the leaded washer 17 and its hole 19 which cooperates with the plumb line 20, as was defined above.

In FIG. 3 there is shown, on the upper face 7 of the bracket, the sheath assembly 1 whose window 21 is housed in recess 15. The bed-plate 5 integral with the sheath assembly 1 is provided, for the passage of securing screws 6 therethrough, with holes 28 whose diameter is greater than that required for passing screws 6 therethrough, the diameter of recess 15 being also greater than that of window 21. The sheath assembly 1 may be positioned and fixed so that the X-ray source 2 is also aligned along axis z—z. To this end, after removal of the plumb line 20 and closure of the hole 18 of the leaded washer 17 with a leaded plug 22, the next phase consists in: centering on the upper plane of seriograph 14 a screen for visualizing the X-rays, being formed by any known means, such for example as a fluorescent screen 23 and emitting X-rays with the sheath assembly 1; this X-radiation (not shown) passing through hole 19 in the leaded washer is visualized by the fluorescent screen 23 on which it may be centered by adjusting the position of the sheath assembly 1 on bracket 4. After which, sheath 1 is fixed by clamping screws 6 and the leaded washer 17 is removed.

This forms a new important characteristic of the invention which allows rapid alignment of the X-ray source 2 to be achieved owing to the position of the sheath assembly 1 on a support already aligned, which is bracket 4, and also allows this alignment to be carried out before the diaphragm 3 is installed, which permits use of the operating axis $z_1$—$z_1$ of seriograph 14 as positional reference because of leaded washer 17 and its hole 19, which cooperates with the X-radiation beam emitted by the sheath assembly 1, as was previously described.

A last phase consists in aligning and fixing diaphragm 3 (FIG. 1) on the lower face 8 of bracket 4, by means of screws 9; this diaphragm comprises a collar 24 and beam limiting flaps, which are not shown, centered by construction with respect to collar 24. This latter, whose external diameter is identical with that of the leaded washer 17, is housed in recess 16 of bracket 4.

With this arrangement, which is a new feature of the invention, diaphragm 3, which comprises a means for centering its position formed by collar 24 cooperating with recess 16, is correctly positioned as soon as it is fixed to bracket 4.

Diaphragm 3 also comprises grooves 25, in which a leaded plate 26 may be slid and centered having an aperture 27 centrally therethrough; this leaded plate 26 is used for re-alignment when a defective sheath assembly 1 is replaced.

In this case, a single one of the alignment points already provided is likely to be destroyed, and the correct positioning of the new sheath assembly 1 is obtained without removing diaphragm 3, by proceeding as for the first sheath assembly 1. The emission of X-radiation which, passing through aperture 27 in leaded plate 26, is visualized by a fluorescent screen 23 centered on the operating axis $z_1$—$z_1$ of seriograph 14, may be centered on the fluorescent screen 23 by adjusting the position of sheath assembly 1 on bracket 4.

Grooves 25 in diaphragm 3 form a means by which the X-ray emitting assembly may cooperate with a second alignment means; this second alignment means formed by the leaded plate 26 and its aperture 27, which cooperates with the X-ray beam emitted by the sheath assembly 1, allows this latter to use the operating axis $z_1$—$z_1$ of seriograph 14 as positional reference, so as to determine its alignment with respect thereto, as has already been mentioned.

This shows that an X-ray emitting assembly in accordance with the invention enables the sheath assembly 1 to be replaced and re-aligned easily and rapidly without requiring removal of diaphragm 3.

Such an X-ray emitting assembly may be used with any radiology stand not requiring rotation of the sheath in its collars.

What is claimed is:

1. In an X-ray emitting assembly, comprising a flange for assembling a sheath assembly and a beam limiting device, operationally associated with one or more radiation detectors situated in a radiology equipment stand, said flange is adapted to cooperate with alignment means, so as to determine in a first stage, the positioning of said flange with respect to the operating axis of one of the radiation detectors and, in a second stage, to enable alignment along this axis of the operating axes of the sheath assembly and of the beam limiting device; said sheath assembly and said beam limiting device are fixed to said flange, independently of each other;

said flange is a bracket adjustable in position; and said bracket comprises a recess for receiving in a first phase a leaded washer having a hole centrally therethrough and in a second phase a centering means integral with said beam limiting device.

2. The X-ray emitting assembly as claimed in claim 1, wherein, in a first phase, passage of a plumb line through said hole enables said bracket to be aligned with respect to the operating axis of said radiation detector.

3. The X-ray emitting assembly as claimed in claim 1, wherein said sheath assembly comprises means for modifying its fixing position on said bracket.

4. The X-ray emitting assembly as claimed in claim 3, wherein, in the first phase, the passage of an X-radiation emitted by said sheath assembly through said hole determines the alignment of said sheath along the operating axis of said radiation detector.

5. The X-ray emitting assembly as claimed in claim 1, wherein the means for centering the position of said beam limiting device is formed by a collar and said recess.

6. The X-ray emitting assembly as claimed in claim 5, wherein said beam limiting device further comprises means for receiving a leaded plate having an aperture centrally therethrough centered on the operating axis of said radiation detector.

7. The X-ray emitting assembly as claimed in claim 6, wherein the passage of the X-radiation emitted by the sheath assembly into said aperture determines the alignment of said sheath with respect to the operating axis of said radiation detector.

8. An X-ray emitting assembly, operationally associated with at least one radiation detector having an operating axis, all mounted in a radiology equipment stand, said X-ray emitting assembly comprising a flange; a sheath assembly and a beam limiting device which are fixed to said flange independently of each other; said flange is a bracket adjustable in position, said bracket having a recess for receiving, in a first phase a leaded washer having a hole centrally therethrough, and in a second phase a centering means integral with said beam limiting device, in order to cooperate with alignment means to determine in a first stage, the positioning of said flange with respect to the operating axis of the radiation detector, in a second stage, to enable alignment along this axis of the operating axes of the sheath assembly and of the beam limiting device.

9. The X-ray emitting assembly as claimed in claim 8 wherein, in a first phase, passage of a plumb line through said hole enables said bracket to be aligned with respect to the operating axis of said radiation detector.

10. The X-ray emitting assembly as claimed in claim 8 or 9, wherein said sheath assembly comprises means for modifying its fixing position on said bracket.

11. The X-ray emitting assembly as claimed in claim 8 or 9, wherein, in a second phase, the passage of an X-radiation emitted by said sheath assembly through said hole determines the alignment of said sheath along the operating axis of said radiation detector.

12. The X-ray emitting assembly as claimed in claim 8, wherein the means for centering the position of said beam limiting device is formed by a collar and said recess.

13. The X-ray emitting assembly as claimed in claim 8, wherein said beam limiting device further comprises means for receiving a leaded plate having an aperture centrally therethrough centered on the operating axis of said radiation detector.

14. The X-ray emitting assembly as claimed in claim 13, wherein the passage of the X-radiation emitted by the sheath assembly into said aperture determines the alignment of said sheath with respect to the operating axis of said radiation detector.

* * * * *